United States Patent [19]

Dickinson et al.

[11] Patent Number: 4,591,515

[45] Date of Patent: May 27, 1986

[54] METHOD OF IMPREGNATING WOOD

[75] Inventors: David J. Dickinson, Haywards Heath; Scarlette M. Gray, Colchester, both of England

[73] Assignee: National Research Development Corp., London, England

[21] Appl. No.: 584,260

[22] PCT Filed: May 25, 1983

[86] PCT No.: PCT/GB83/00146

§ 371 Date: Jan. 27, 1984

§ 102(e) Date: Jan. 27, 1984

[87] PCT Pub. No.: WO83/04212

PCT Pub. Date: Dec. 8, 1983

[30] Foreign Application Priority Data

May 27, 1982 [GB] United Kingdom ..... 8215571
Apr. 22, 1983 [GB] United Kingdom ..... 8310973

[51] Int. Cl.[4] ..... B05D 3/00

[52] U.S. Cl. ..... 427/297; 427/343; 427/369; 427/419.1; 427/440

[58] Field of Search ..... 427/440, 419.1, 297, 427/343, 369

[56] References Cited

U.S. PATENT DOCUMENTS 3,007,844 11/1961 Schulz ..... 167/38.5
4,038,086 7/1977 Clarke et al. ..... 427/440
4,323,477 4/1982 Hill ..... 427/440

FOREIGN PATENT DOCUMENTS 451164 10/1935 United Kingdom .
2038184 7/1980 United Kingdom .

*Primary Examiner*—Sam Silverberg
*Assistant Examiner*—Janyce A. Bell
*Attorney, Agent, or Firm*—Oblon, Fisher, Spivak, McClelland & Maier

[57] ABSTRACT

This invention relates to a method of impregnating wood in order to protect it against fungal decay. Conventionally wood has been treated with copper-chromium-arsenic preservatives in a one stage treatment, e.g. by impregnating the wood with a solution of these compounds. The chromium component serves to fix the copper in the wood to prevent it from leaching out. It has now been found that a two-stage treatment in which (1) the copper and fixative agent are impregnated without arsenic and (2) the arsenic is impregnated separately, improves resistance of the wood to soft-rot fungi. The invention is particularly useful for treating hardwoods.

4 Claims, No Drawings

METHOD OF IMPREGNATING WOOD

This invention relates to a method of impregnating wood in order to protect it against fungal decay.

Copper-chrome-arsenic (CCA) water-borne wood preservatives, typically based on a mixture of copper sulphate, sodium or potassium dichromate and arsenic pentoxide, have been available commercially for many years. Pressure impregnation techniques are usually employed to treat the wood and fix the preservatives therein. CCA preservatives are effective against basidiomycetes, which cause white and brown rot in both hard and soft woods, as has been well established over long periods in many countries. The main shortcoming of CCA preservatives is their inability to control adequately copper-tolerant soft rot fungi which attack a wide range of timber species, particularly hard woods, when they are exposed to very wet conditions, for example in ground contact.

Copper-chrome-boron (CCB) water-borne wood preservatives, typically based on a mixture of copper sulphate, sodium or potassium dichromate and boric oxide, have been used for many years where arsenic has been unavailable or its use has been considered undesirable. CCB is generally less effective than CCA in controlling basidiomycetes, partly because the boron is not fixed and is leached from the wood over a period of time. CCB, however, does provide good protection against soft rot fungi, even in hard woods.

Attempts have been made using copper-chrome-arsenic-boron (CCAB) preservatives to combine the activity of CCA and CCB wood preservatives by substituting 50% of the arsenic compound in CCA with boric acid to control both basidiomycetes decay and soft rot in hard wood. The results of trials have shown that a CCAB formulation is less effective than CCB against soft rot.

Other trials with both soft and hard woods have shown that both CCA and CCB are both more effective in controlling decay in wood than a CCAB type formulation. The poor performance of CCAB has been attributed to lack of fixation of the preservative composition in the wood.

We have found, in accordance with the present invention, that a two-stage treatment of wood involving a first stage in which the wood is impregnated with a copper preservative and with a fixative agent therefor and a second stage in which the wood is impregnated with an arsenic preservative provides a broad spectrum of activity against basidiomycetes and soft rot fungi in both soft woods and hard woods, in particular against soft rot fungi attack of hard woods.

What is novel and inventive herein is the finding that carrying out the method in two stages leads to improved resistance of woods to fungal attack. As implied in the above statement, the first stage is carried out in the substantial absence of arsenic. The omission of an arsenical preservative from the copper solution appears to increase the amount of copper which is fixed in the wood shortly after the treatment. Tests have been carried out in which birch sawdust was treated comparably with (i) CCA, (ii) CCB, (iii) CCAB, or (iv) C, i.e. copper sulphate. The treated sawdust was leached and the unleachable copper remaining in the wood was measured. These tests showed that during the period up to 8 hours after treatment the CCB and C treatments gave markedly higher percentages of unleached copper than the other two treatments. However, after that time, the unleached copper in the C treatment fell away and the results of the other 3 tests began to converge until after about 48 hours they were virtually identical. The amount of chromium fixed was initially lower in the CCB treatment than with CCA or CCAB. It is believed, therefore, that the treatment of the invention enables copper to interact better with the cell wall of the wood and that this interaction provides improved protection against soft-rot fungi. The treatment of the invention is therefore carried out so that the first stage provides for interaction of the copper within the cell wall, particularly adsorption thereof to sites within the S2 layer, unimpeded by arsenic, and the second stage provides for the arsenical impregnation to take place on the wood in which copper-cell wall interactions have taken place.

The impregnations of wood can be carried out by any of the usual procedures. Broadly stated there are two general methods. One involves simply dipping or steeping the wood in the impregnant solution or spraying the wood with it, whereby the impregnant solution diffuses into the wood at atomspheric pressure. Care must be taken not to let the wood dry out too quickly or the solution will not penetrate to a sufficient depth. The other involves creating a pressure gradient across the wood by evacuating the wood before impregnating it or applying the impregnating solution under pressure, or both. Pressures from atomspheric upwards to 400 psi (28 atomspheres) are generally usable, the most usual range being from 150 to 180 psi (10 to 13 atmospheres). Generally, any treatment process used for copper impregnation is useful in the present invention and such processes are well documented.

The temperature of impregnation, and of the whole process, is conveniently ambient, a typical range being 10° to 35° C., but a temperature as high as 50° or even 100° C. can be envisaged. Obviously, care must be taken in selecting an elevated temperature if the impregnating solvent is partly or wholly organic. The invention is, however, primarily of interest when the impregnating solvent is water.

The copper compound is preferably copper sulphate but other salts such as basic copper carbonate or copper(II) oxide or hydroxide can be used. The copper is fixed in the wood with the aid of a fixative agent. This can be a chromium (VI) compound such as chromium trioxide or a dichromate such as sodium or potassium dichromate. The hexavalent chromium is reduced in the wood to the trivalent state. In the trivalent state it serves as a fixative for the arsenical preservative added later. Alternatively an ammonia or ammonia-providing fixative agent for the copper can be used. In that event the arsenical preservative will need to be fixed in the second stage by, e.g. an ammoniacal or chrome fixative agent.

Use of a boron preservative, e.g. boric acid, in the first stage is optional. Although a boron component is included in all the Examples herein it will be clear to those skilled in this art that the boron component is readily leached out of wood and it is therefore obvious that it can be omitted without affecting the principle of the invention.

The second stage of treatment can be carried out shortly after the first, but the interval between should be sufficient to allow the copper to interact with the cell wall. This time interval would be governed by the time taken for significant interaction to take place and would therefore be somewhat arbitrary. In general however, the interval is expected to be from 3 minutes upwards. It is all right to carry out the second impregnation after fixing of the copper has taken place, e.g. up to 6 months after the treatment if desired.

The arsenical preservative is preferably in the pentavalent form, e.g. sodium arsenate or arsenic (V) oxide ($As_2O_5$).

The concentrations of preservatives used will in general be from one half to 10% w/v CCA equivalents, i.e. to provide the same amounts of copper, arsenic and, when used, chromium as in a CCA solution of the same concentration containing 35% by weight $CuSO_4.5H_2O$, 45% by weight $K_2Cr_2O_7$ and 17% by weight $As_2O_5$. Thus the copper concentration will typically be from 0.04 to 0.9% w/v (0.4 to 9 g/liter) and the arsenic concentration 0.05 to 1.1% w/v (0.5 to 11 g/liter). Preferred ranges are 1.5 to 6, especially 3 to 6% w/v CCA equivalents. When a boron preservative is used any concentration equivalent to that in which it is present in a CCB will in general be appropriate.

The wood treated can be a softwood or hardwood (angiosperm or gymnosperm).

The following Examples illustrate the invention. Concentrations of treating solutions and ingredients thereof are expressed as weight/volume (g/100 ml). Analyses of elements retained and other percentages are weight/weight. Treatments of the wood are carried out by evacuating the wood followed by total immersion at ordinary pressure in accordance with European Standard EN 113 or a superatmospheric pressure. The wood was stored wet for 2 weeks and gradually allowed to air-dry for the following 2 weeks. This storage and drying procedure was used between the stages of the two stage treatments and at the end of all the treatments.

EXAMPLE 1

Small birch blocks were treated with a preservative solution (EN 113) and leached (EN 84) before being exposed to a monoculture of *Chaetomium globosum* (FPRL S70). Treatment solutions having various concentrations were used (over the range 0.4, 0.8, 1.6, 2.6 and 3.7% w/v), in accordance with each of the following five treatments:

1. CCA A single treatment with a CCA treating solution at the stated concentration, followed by storage and drying to fix the preservative. The CCA was composed of 35% by weight $CuSO_4.5H_2O$, 45% by weight $K_2Cr_2O_7$ and 17% by weight $As_2O_5$. The 3.7% w/v treating solution contained 0.33% Cu, 0.59% Cr and 0.41% As, w/v. Other solutions were derived by dilution.

2. CCB A single stage treatment using a CCB solution, followed by storage and drying to fix the preservative. The 3.7% treating solution contained CCA equivalents of copper and chrome, i.e. 0.33% Cu and 0.59% Cr. Boron was supplied as $H_3BO_3$ and the 3.7% solution contained 0.13% B.

3. CCAB A single stage treatment with a CCAB treating solution, followed by storage and drying to fix the preservative. The 3.7% treating solution contained CCA and CCB equivalents of copper, chrome, arsenic and boron, i.e. 0.33% Cu, 0.59% Cr, 0.41% As and 0.13% B.

4. B-CCA A two stage treatment involving initial treatment with $H_3BO_3$, followed by storage and drying, and a second treatment with CCA as in 1, followed by storage and drying to fix the preservative. The boron was supplied in the first stage as $H_3BO_3$ to provide, for the 3.7% treatment solution, 0.13% B. Again, CCA equivalents of the other elements were used, i.e. for the 3.7% treatment solution the same amounts of Cu, Cr and As as for CCA treatment 1.

5. CCB-A A two stage treatment involving an initial treatment with CCB as in 2, followed by storage and drying to fix the preservative, and a second treatment with arsenic (as $As_2O_5$), followed by storage and drying. Again, CCA and CCB equivalents of copper, chrome, boron and arsenic were used.

The effectiveness of each treatment was determined by assessing the weight loss of the birch blocks attributable to soft rot over a period of six or eight weeks.

The following Table 1 indicates the comparative effectiveness of the various treatments against soft rot in birch:

TABLE 1

| Treatment | | Effectiveness |
|---|---|---|
| 1 | CCA | + |
| 2 | CCB | +++ |
| 3 | CCAB | ++ |
| 4 | B-CCA | – |
| 5 | CCB-A | ++++ |

– significant wt loss at all concentrations
+ (poorest level)
++++ (best level)

It will be seen from the Table 1 above that although treatments 3, 4 and 5 involve the use of essentially the same constituents in the same proportions, very different results are achieved. The CCB-A treatment 5 is the most effective of the various treatments, being significantly more effective than the CCB treatment, hitherto regarded as the best alternative available for the treatment of soft rot in hard woods. Of the treatment tests, B-CCA 4 gave the worst results, even worse than the CCA 1 treatment.

Further tests have demonstrated a broad spectrum of activity for the CCB-A treatment. Both birch and Scots pine blocks were treated with a range of concentrations of CCA, CCB and CCB-A, leached and exposed to *Coniophora puteana* (FPRL 11E), *Coriolus versicolor* (FPRL 28A), *C. globosum* and *Phialophora fastigiata* (FPRL S6A). It was found that the CCB-A treatment was the most effective of the various treatments against soft rot in the hard wood (birch) and at least as effective as the other treatments against white and brown rot in hard woods and white rot, brown rot and soft rot in the soft wood (Scots pine).

EXAMPLE 2

To discover whether the superior results obtained from the CCB-A treatment of the invention were related to the amounts of the elements C, C, B and A retained in the wood, replicate birch blocks subjected to the treatments of Example 1 were analysed chemically. Three blocks treated at each of the 5 concentrations by each of the 5 treatments were milled to make woodflour which was extracted using the method described in British Standard 5666 Part 3. An argon plasma emission spectrometer was used to analyse the extracts (leachates) for copper, chromium arsenic and boron. The mean retention for blocks of each treatment concentration was calculated as % w/w.

At most of the concentrations the retention of each of copper and chrome was lower in the CCB-A treated blocks than in any of the others. The retention of arsenic in the CCB-A treated blocks, compared with the other arsenical treatments, i.e. CCA, CCAB and B-CCA, showed a similar trend. Data giving weight losses of the blocks and mean copper retentions determined analytically are presented in Table 2. Table 2 confirms the superiority of the CCB-A treatment of the invention, since it shows very much reduced weight losses of the wood. Table 2 also confirms that the adoption of the 2-stage, CCB-A, treatment does not bring about increased copper retention. This is consistent with the hypothesis put forward above that adsorption of the copper onto sites within the S2 layer of the wood takes place preferentially in the absence of arsenic.

No boron was found in any of the blocks, i.e. it had been completely leached out. This result indicates that the boron component is not markedly effetive and can be omitted.

TABLE 2

Mean weight loss and copper retentions by analysis, in birch tested against Chaetomium globosum

| Treatment % w/v CCA equiv. | | Mean weight loss % | (Standard error) | Mean Cu retention by analysis (% w/w) | (Standard error) |
|---|---|---|---|---|---|
| CCA | 0.4 | 42.30 | (6.45) | 0.042 | (0.002) |
| | 0.8 | 37.42 | (2.66) | 0.065 | (0.003) |
| | 1.6 | 20.65 | (1.21) | 0.120 | (0.005) |
| | 2.6 | 6.41 | (1.37) | 0.168 | (0.004) |
| | 3.7 | 3.08 | (0.80) | 0.235 | (0.005) |
| CCB | 0.4 | 48.72 | (2.26) | 0.037 | (0.002) |
| | 0.8 | 33.45 | (1.32) | 0.068 | (0.002) |
| | 1.6 | 9.21 | (0.99) | 0.140 | (0.006) |
| | 2.6 | 4.32 | (0.73) | 0.188 | (0.011) |
| | 3.7 | 3.06 | (0.82) | 0.270 | (0.005) |
| CCAB | 0.4 | 50.42 | (2.56) | 0.032 | (0.002) |
| | 0.8 | 34.67 | (2.90) | 0.067 | (0.002) |
| | 1.6 | 18.25 | (0.71) | 0.117 | (0.002) |
| | 2.6 | 3.95 | (0.74) | 0.177 | (0.004) |
| | 3.7 | 2.57 | (0.59) | 0.225 | (0.012) |
| B-CCA | 0.4 | 54.21 | (3.29) | 0.032 | (0.002) |
| | 0.8 | 41.55 | (2.91) | 0.062 | (0.002) |
| | 1.6 | 20.70 | (2.34) | 0.107 | (0.004) |
| | 2.6 | 7.18 | (0.52) | 0.172 | (0.007) |
| | 3.7 | 4.19 | (0.70) | 0.227 | (0.004) |
| CCB-A | 0.4 | 35.81 | (3.37) | 0.037 | (0.002) |
| | 0.8 | 21.29 | (2.66) | 0.058 | (0.002) |
| | 1.6 | 2.16 | (0.65) | 0.163 | (0.009) |
| | 2.6 | 4.16 | (0.75) | 0.158 | (0.002) |
| | 3.7 | 1.25 | (0.33) | 0.200 | (0.008) |
| Untreated | | 3.98 | (3.16) | | |

EXAMPLE 3

Small birch and Scots pine stakes (5×10 150 mm) were treated with a range of concentrations of each of CCA, CCB and CCB-A, cold water-leached (saturated) and exposed in a soil-bed in a room maintained at 20° C. and 85% relative humidity. At intervals during a 400 day period, each birch stake was removed and deflected in a static bending apparatus. From the deflection the modulus of elasticity (M.O.E.) was calculated and expressed as a percentage of the original M.O.E. (before exposure). This value was termed the % residual strength. Stakes which failed under load were said to have a residual strength of 0%. Weight loss determinations were made on the birch and Scots pine stakes remaining at the end of the exposure period.

Table 3 below shows the residual strength of the birch after 400 days for each kind of treatment.

TABLE 3

Mean % residual strengths of treated birch after 400 days' exposure in the soil-bed

| Treatment (w/v %) | | Residual strength (%) | (Standard error) |
|---|---|---|---|
| CCA | 0.4 | 0.0 | (0.00) |
| | 0.8 | 1.5 | (1.45) |
| | 1.6 | 12.8 | (2.56) |
| | 2.6 | 42.1 | (6.10) |
| CCB | 0.4 | 0.0 | (0.00) |
| | 0.8 | 8.0 | (1.79) |
| | 1.6 | 13.7 | (1.92) |
| | 2.6 | 33.6 | (6.13) |
| CCB-A | 0.4 | 0.0 | (0.00) |
| | 0.8 | 5.5 | (1.99) |
| | 1.6 | 23.4 | (3.55) |
| | 2.6 | 51.4 | (3.48) |

It will be seen from Table 3 that where the preservatives are used in a high enough concentration to be reasonably effective over a 400 day period the CCB-A treatment is significantly superior to the CCA and CCB. Table 4 below shows the same trend in weight loss terms in relation to birch. The results for Scots pine, also included in Table 4, show the superiority of the CCB-A treatment at the lowest concentration. At the 0.8% and higher concentrations all treatments were about equally effective in preventing loss of the weight. The results indicate the probability that hard and soft woods can be treated effectively with lower concentrations of copper and chrome than have been used hitherto, if a two-stage treatment of the invention is applied.

TABLE 4

Mean weight losses in birch and in scots Pine after 400 days exposure in the soil-bed

| Treatment (w/v %) | | BIRCH Weight loss (%) | BIRCH (Standard error) | SCOTS PINE Weight loss (%)* | SCOTS PINE (Standard error) |
|---|---|---|---|---|---|
| CCA | 0.4 | 52.63 | (3.70) | 15.02 | (1.30) |
| | 0.8 | 44.48 | (2.33) | 4.06 | (0.54) |
| | 1.6 | 37.39 | (2.93) | 0.23 | (0.16) |
| | 2.6 | 22.30 | (2.17) | −1.21 | (0.05) |
| | 3.7 | 14.86 | (1.65) | −2.41 | (0.12) |
| CCB | 0.4 | failed before 400 days | | 24.14 | (2.11) |
| | 0.8 | 44.09 | (1.37) | 3.62 | (0.29) |
| | 1.6 | 35.94 | (1.33) | 0.66 | (0.07) |
| | 2.6 | 24.20 | (1.77) | 0.04 | (0.23) |
| | 3.7 | 15.71 | (0.91) | −0.19 | (0.18) |
| CCB-A | 0.4 | 52.12 | (1.21) | 7.66 | (1.21) |
| | 0.8 | 40.43 | (0.80) | 3.31 | (0.63) |
| | 1.6 | 31.21 | (1.70) | 0.67 | (0.15) |
| | 2.6 | 18.03 | (0.94) | −0.50 | (0.41) |
| | 3.7 | not measured | | −2.57 | (0.20) |

*minus signs denote weight gain.

We claim:

1. A method of impregnating wood to protect it against fungal decay, which method comprises a first stage of impregnating the wood with a solution of a copper compound and with a fixative agent for the copper compound, but in the substantial absence of arsenic, followed by a second stage of impregnating the wood with a solution containing an arsenic compound, both said impregnations being carried out at a temperature of from 10° to 35° C., and wherein in the first stage the fixative agent comprises (a) a chromium (VI) compound or (b) ammonia or an ammonia-releasing compound, and in the case of (b) the second stage further comprises impregnating the wood with a fixative agent for the arsenic compound comprising a chromium (VI)

compound or ammonia or an ammonia-releasing compound.

2. A method according to claim 1, wherein in the first stage the wood is also impregnated with a boron preservative.

3. A method according to claim 1 wherein in the first stage the wood is impregnated with a solution containing from 0.4 to 9 g/liter of copper, calculated as Cu, and after a period of from 3 minutes to 6 months, is subjected to the second stage in which it is impregnated with a solution containing from 0.5 to 11 g/liter of arsenic, calculated as As.

4. A method according to claim 1, 2 or 3, wherein both said impregnations are carried out by first evacuating the wood and then impregnating it.

* * * * *